US005488206A

United States Patent [19]

Wu

[11] Patent Number: 5,488,206

[45] Date of Patent: Jan. 30, 1996

[54] JOYSTICK SWITCH ASSEMBLY

[76] Inventor: Donald Wu, 12F., No. 59, Chang Chun Road, Taipei, Taiwan

[21] Appl. No.: 361,487

[22] Filed: Dec. 22, 1994

Related U.S. Application Data

[63] Continuation-in-part of Ser. No. 188,808, Jan. 31, 1994.

[51] Int. Cl.[6] ..... H01H 25/04

[52] U.S. Cl. ..... 200/6 A; 200/511

[58] Field of Search ..... 200/5 R, 5 A, 200/6 A, 511, 553, 557; 345/161, 168, 169

[56] References Cited

U.S. PATENT DOCUMENTS 4,324,472 4/1982 Terada et al. ..... 200/264 X
4,408,103 10/1983 Smith, III ..... 200/6 A
4,511,769 4/1985 Sahakian et al. ..... 200/6 A
4,614,847 9/1986 Sasao ..... 200/6 A

*Primary Examiner*—J. R. Scott
*Attorney, Agent, or Firm*—Jacobson, Price, Holman & Stern

[57] ABSTRACT

A joystick switch assembly including a housing with an open-top covered with a cover shell, a stick extended out of the cover shell and having a contact plate at the bottom received within the housing, a membrane circuit mounted around the stick and disposed between the cover shell and the contact plate of the stick, a conductive rubber mounted around the stick and disposed between the membrane circuit and the contact plate of the stick, wherein when the stick is moved within the housing, the circular contact plate is forced to press the conductive rubber and the membrane circuit, causing the membrane circuit to produce a signal output corresponding to the direction of the movement of the stick.

6 Claims, 5 Drawing Sheets

JOYSTICK SWITCH ASSEMBLY

CROSS-REFERENCE OF RELATED APPLICATION

This is a continuation-in-part to co-pending parent application Ser. No. 08/188,808 filed on Jan. 31, 1994, entitled "Joystick Switch Assembly".

Referring to FIG. 5, the joystick switch assembly of U.S. patent application Ser. No. 08/188,808 is comprised of a rubber cap 21, a stick 22, a cover shell 23, an upper membrane circuit 24, an upper conductive rubber 25, a lower membrane circuit 26, a lower conductive rubber 27, and a bottom shell 28. The bottom shell 28 is made of cup-like shape defining a storage chamber 281 and having a recessed bearing block 282 inside the storage chamber 281, which bears the stub rod 223 of the stick 22, and a plurality of raised portions 283 spaced around the topmost edge thereof and respectively fitted into the recessed holes 232 on the cover shell 23. The stick 22 comprises a stick body 221 and a contact plate 222 at the bottom of the stick body 221. The contact plate 22 of the stick 22 comprises two convex portions 222A respectively disposed on two opposite sides thereof, and a bottom stub rod 223 raised from the bottom side thereof in the center. The upper membrane circuit 24 has a through hole 241 aligned with the center through hole 231 on the cover shell 23, and an extension portion 242 electrically connected to the lower membrane circuit 26. The lower membrane circuit 26 has a through hole 261 aligned with the through hole 241 on the upper membrane circuit 24, and an extension portion 262 electrically connected to the extension portion 242 of the upper membrane circuit 24. The cover shell 23 comprises a center through hole 231, which receives the stick body 221 of the stick 21, and a plurality of recessed holes 232 spaced on the bottom surface thereof around the center through hole 231. The upper and lower conductive rubbers 25;27 have a respective through hole 251 or 271 aligned with the through holes 241;261 on the upper and lower membrane circuits 24;26. The rubber cap 21 is mounted on the stick body 221 of the stick 22 at the top. The stick body 221 of the stick 22 inserts in proper order through the through hole 251 on the upper conductive rubber 25, the through hole 241 on the upper membrane circuit 24, and the center through hole 231 on the cover shell 23. The stub rod 223 of the stick body 222 of the stick 22 inserts through the through hole 271 on the lower conductive rubber 27 and the through hole 261 on the lower membrane circuit 26 and then supported on the recessed bearing block 282 of the bottom shell 28. When assembled, the connecting area between the recessed holes 232 and the raised portions 283 is sealed through an ultrasonic welding process.

The aforesaid structure of joystick switch assembly is functional, however it is complicated and expensive to manufacture because it consists of too many parts.

SUMMARY OF THE INVENTION

The present invention has been accomplished to provide an improved structure of joystick switch assembly which eliminates the aforesaid drawbacks. The present invention utilizes fewer number of parts to achieve the same function. The improved structure of joystick switch assembly of the present invention eliminates the lower membrane circuit and the lower conductive rubber from the joystick switch assembly and also eliminates the raised portions and the recessed holes from the bottom shell and the cover shell respectively, and directly fasten the bottom shell and the cover shell together by welding.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
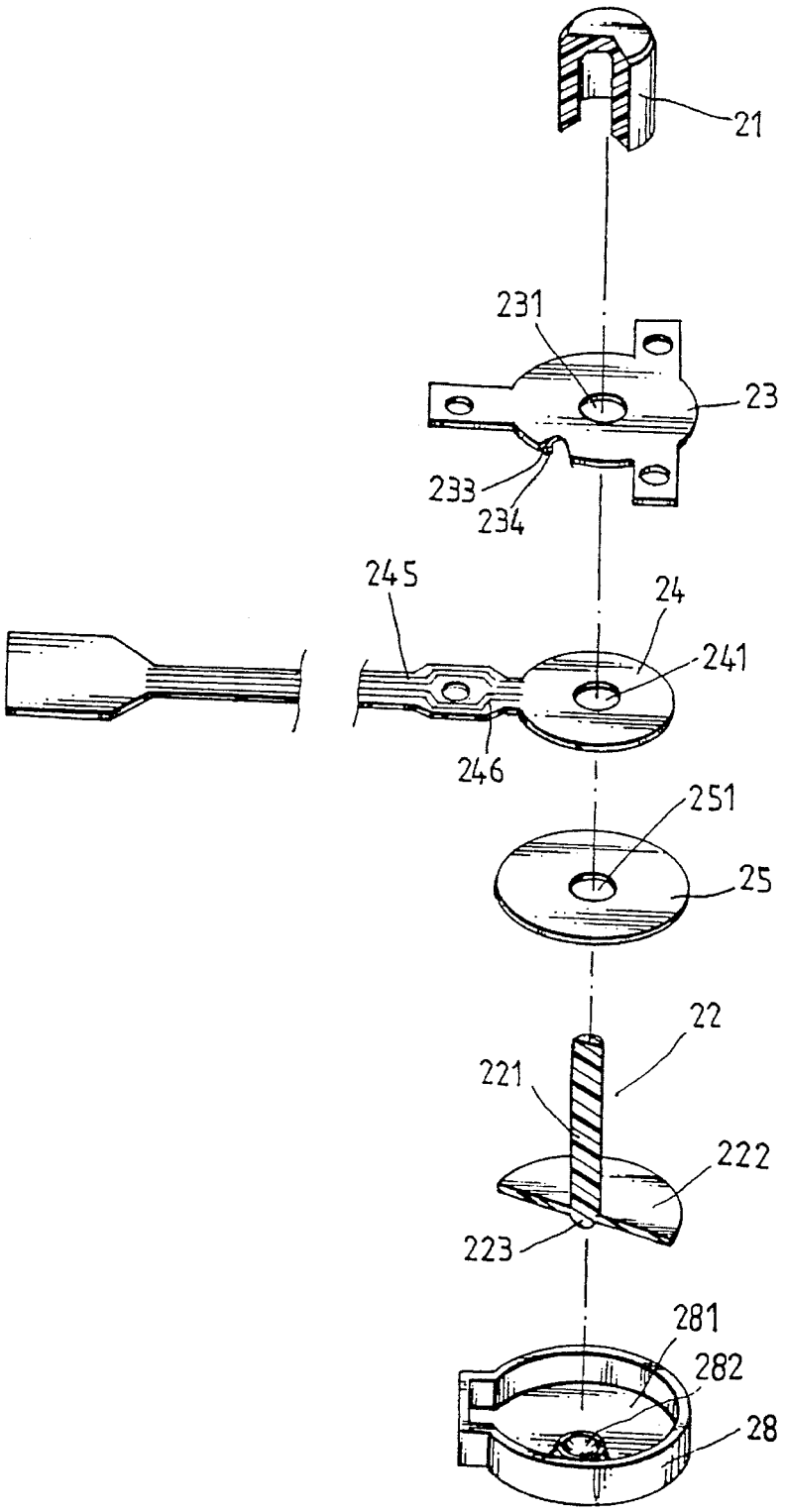
FIG. 1 is an exploded view of an improved structure of a joystick switch assembly according to the present invention.

Referring to FIG. 1, a joystick switch assembly in accordance with the present invention is generally comprised of a rubber cap 21, a stick 22, a cover shell 23, a membrane circuit 24, a conductive rubber 25, and a bottom shell 28.

Referring to FIG. 1 again, the stick 22 comprises a contact plate 222 and an elongated stick body 221 raised from the center of the contact plate 222 at one side. The contact plate 222 of the stick 22 has a bottom stub rod 223 raised from the bottom side thereof in the center and fitted into a recessed bearing block 282 on the bottom shell 28. The conductive rubber 25, the membrane circuit 24, the cover shell 23, and the rubber cap 21 are respectively mounted on the stick body 221 in proper order.

The conductive rubber 25 is preferably made of flat, circular shape and closely attached to the contact plate 222 of the stick 22, having a through hole 251 through which the stick body 221 passes.

The membrane circuit has a through hole 241 aligned with the through hole 251 on the conductive rubber 25 for the passing of the stick body 221, and an extension portion 245 embedded with conductor lines 246 for location signal output.

Figure 2:
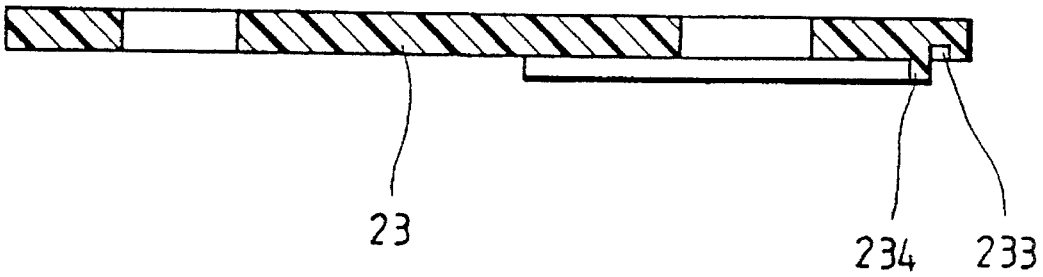
FIG. 2 is a sectional view of the cover shell shown in FIG. 1.
Figure 3:
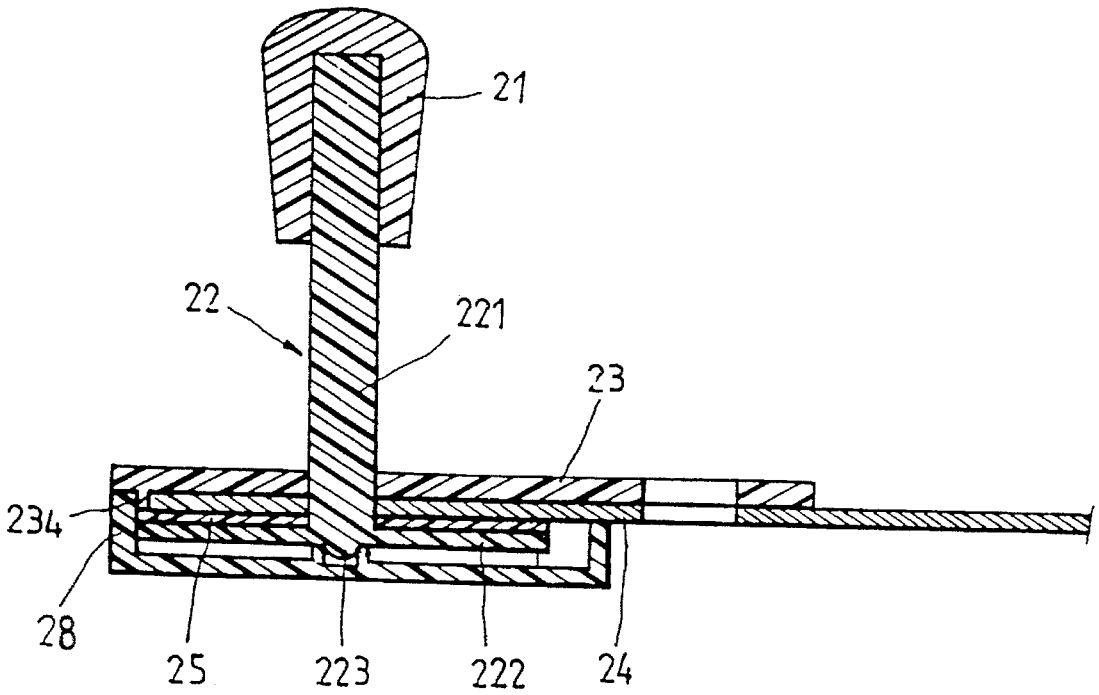
FIG. 3 is a longitudinal view in section of the joystick switch assembly shown in FIG. 1.

The cover shell 23 comprises a center through hole 231, which receives the stick body 221 of the stick 22, an annular bottom flange 234 located on one side of the cover shell 23 which presses the border of the conductive rubber 25, and a bottom groove 232 around the annular bottom flange 232 (see FIG. 2). The bottom groove 233 receives the bottom shell 28, permitting the bottom shell 28 and the cover shell 23 to be conveniently welded together. The bottom shell 28 is a housing with an open-top defining a storage chamber 281 and having a recessed bearing block 282 inside the storage chamber 281, which bears the stub rod 223 of the stick 22. The rubber cap 21 is mounted on the stick body 221 of the stick 22 and covered on the cover shell 23 (see FIG. 3). The stick body 221 of the stick 22 inserts in proper order through the through hole 251 on the conductive rubber 25, the through hole 241 on the membrane circuit 24, and the center through hole 231 on the cover shell 23, and then coupled to the rubber cap 21 (see FIG. 3). The stub rod 223 of the stick body 222 of the stick 22 is supported on the recessed bearing block 282 of the bottom shell 28.

When the joystick switch assembly is not moved, the stick 22 is supported on the recessed bearing block 282 of the bottom shell 28. When the stick body 221 is moved by he operator, the contact plate 222 is tilted to press the conductive rubber 25, the conductor lines 246 of the membrane circuit 24, and the bottom flange 232 of the cover shell 23, causing the membrane circuit 24 to produce an output, which is employed as a means to let the computer detect the direction of the stick 22.

Furthermore, a silicon rubber cushion (not shown) may be mounted within the bottom shell 28 to support the stub rod 223 of the stick, so as to improve the contact sensitivity between the stick 22 and the conductive rubber 25 and membrane circuit 24.

Figure 4:
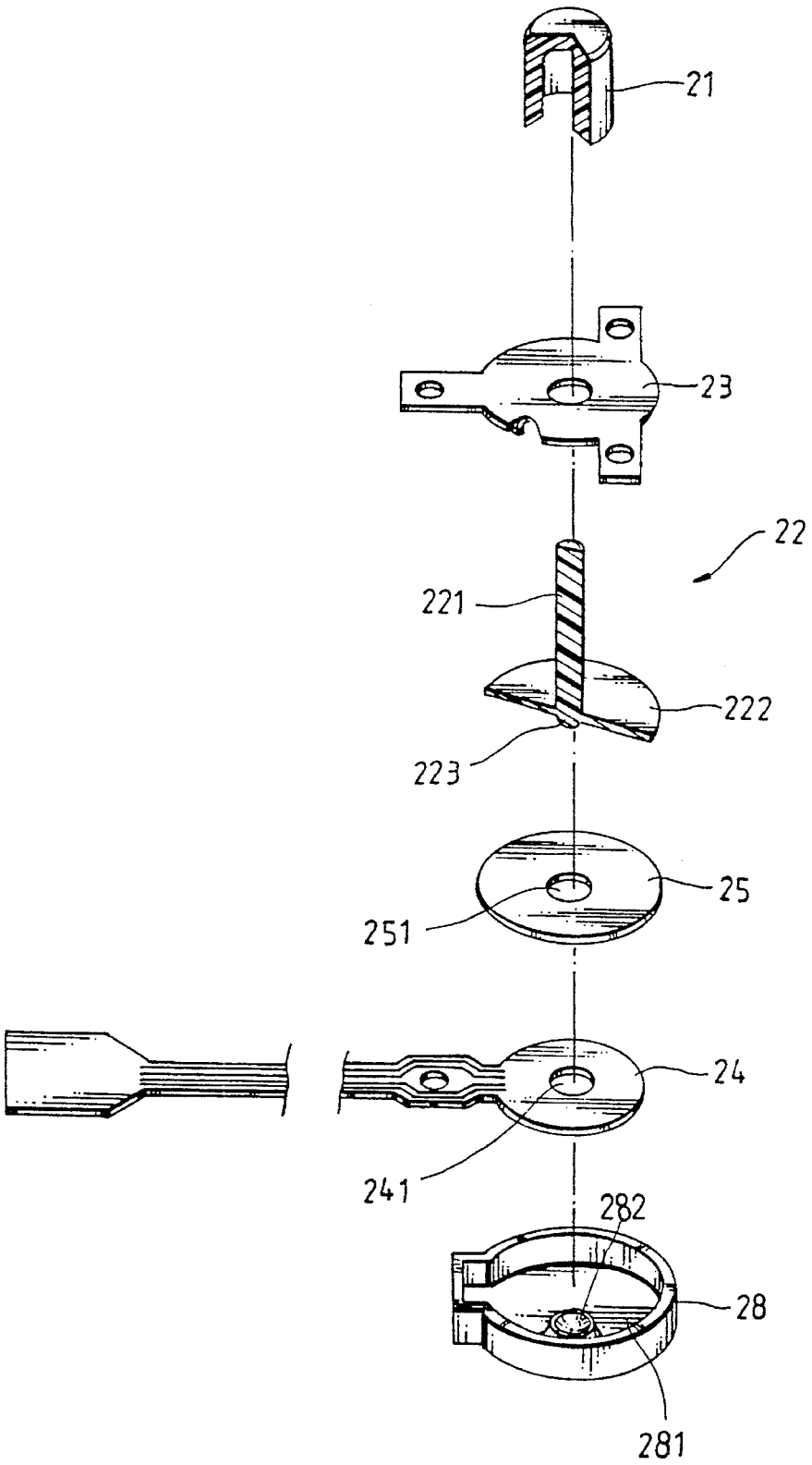
FIG. 4 is an exploded view of an alternate form of the present invention.
Figure 5:
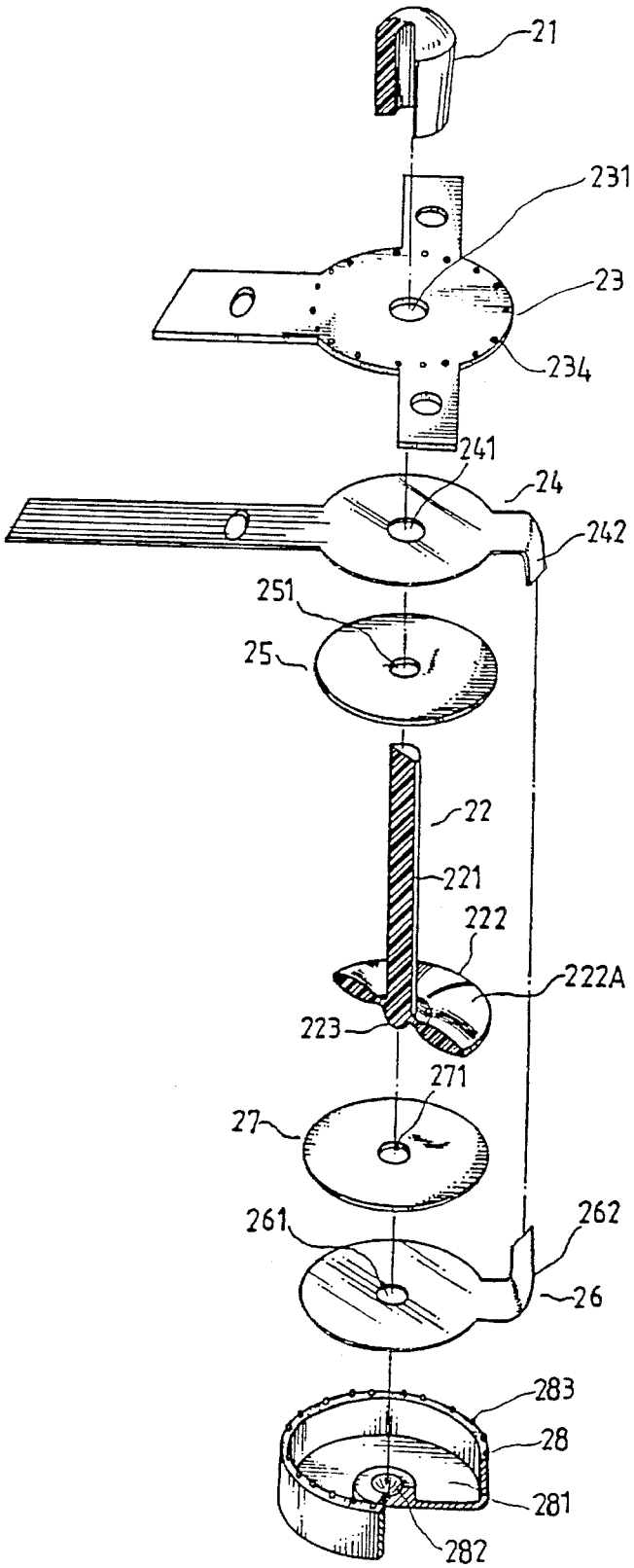
FIG. 5 is an exploded view of the joystick switch assembly of U.S. patent application Ser. No. 08/188,808.

FIG. 4 shows an alternate form of the present invention in which the conductive rubber 25 and the membrane circuit 24 are disposed between the stick 22 and the bottom shell 28, the stub rod 223 of the stick 22 is inserted through the through hole 251 on the conductive rubber 25 and the through hole 241 on the membrane circuit 24 and then coupled to the bearing block 282 of the bottom shell 28. Therefore, when the joystick switch assembly does not work, the stick 22 is supported on the recessed bearing block 282 of the bottom shell 28. When the stick body 221 is moved by the operator, the contact plate 222 is tilted to downwards press the conductive rubber 25 against conductor lines 246 of the membrane circuit 24, causing the membrane circuit 24 to produce an output corresponding to the direction of the movement of the stick 22. Furthermore, a silicon rubber cushion (not shown) may be supported between the contact plate 222 of the stick 22 and the cover shell 23, so as to improve the contact sensitivity between the stick 22 and the conductive rubber 25 and membrane circuit 24.

While only few embodiments of the present invention have been shown and described, it will be understood that various modifications and changes could be made without departing from the spirit and scope of the invention.

What is claimed is:

1. A joystick switch assembly comprising:

a housing with an open-top defining a storage chamber, said housing comprising a recessed bearing block located on the inside bottom of said housing;

a cover shell covered on said housing, said cover shell comprising a center through hole, and an annular bottom flange located on one side of said cover shell;

a stick, said stick comprising a contact plate received within the storage chamber of said housing, a stick body raised from one side of said contact plate at the center and extended out of the center through hole on said cover shell, and a stub rod raised from an opposite side of said contact plate at the center and supported on said recessed bearing block;

a membrane circuit mounted around said stick body and disposed between said cover shell and the contact plate of said stick, said membrane circuit having a through hole, through which said stick body of said stick passes, and an extension portion having conductor lines, wherein the extension portion extends out of said housing; and a circular conductive rubber mounted around said stick body and disposed between said membrane circuit and the contact plate of said stick and received within said annular flange of said cover shell, having a through hole through which said stick body of said stick passes;

wherein when said stick is moved within said housing, said contact plate is forced to press said conductive rubber and said membrane circuit, causing said membrane circuit to produce a location signal output corresponding to the direction of the movement of said stick such that the location signal output is transmitted along the extension portion by the conductor lines.

2. The joystick switch assembly of claim 1 further comprising a rubber cap covered on said stick body and disposed outside said cover shell for holding by hand.

3. The joystick switch assembly of claim 1 wherein said cover shell comprises an annular groove around said annular bottom flange to which the periphery of said housing is welded.

4. A joystick switch assembly comprising:

a housing comprising an inside bottom and an open-top defining a storage chamber, said housing comprising a recessed bearing block located on the inside bottom of said housing;

a cover shell covered on said housing, said cover shell comprising a center through hole, and an annular bottom flange located on one side of said cover shell;

a stick, said stick comprising a contact plate received within the storage chamber of said housing, a stick body raised from one side of said contact plate at the center and extended out of the center through hole on said cover shell, and a stub rod raised from an opposite side of said contact plate at the center and supported on said recessed bearing block;

a membrane circuit mounted around said stub rod of said stick and disposed between said contact plate of said stick and the inside bottom of said housing, said membrane circuit having a through hole, through which said stub rod of said stick passes, and an extension portion having conductor lines, wherein the extension portion extends out of said housing; and a circular conductive rubber mounted around said stub rod of said stick and disposed between said membrane circuit and the contact plate of said stick, having a through hole through which said stub rod passes;

wherein when said stick is moved within said housing, said contact plate is forced to press said conductive rubber and said membrane circuit, causing said membrane circuit to produce a location signal output corresponding to the direction of the movement of said stick such that the location signal output is transmitted along the extension portion by the conductor lines.

5. The joystick switch assembly of claim 4 further comprising a rubber cap covered on said stick body and disposed outside said cover shell for holding by hand.

6. The joystick switch assembly of claim 4 wherein said cover shell comprises an annular groove around said annular bottom flange to which the periphery of said housing is welded.

* * * * *